US007147364B2

(12) United States Patent
Oohashi et al.

(10) Patent No.: US 7,147,364 B2
(45) Date of Patent: Dec. 12, 2006

(54) MIXER AND LIQUID ANALYZER PROVIDED WITH SAME

(75) Inventors: Tomoki Oohashi, Chiyoda (JP); Yasuhiko Sasaki, Tsuchiura (JP); Masahito Ito, Hitachinaka (JP); Hironori Kaji, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 127 days.

(21) Appl. No.: 10/902,036

(22) Filed: Jul. 30, 2004

(65) Prior Publication Data

US 2005/0068845 A1 Mar. 31, 2005

(30) Foreign Application Priority Data

Sep. 29, 2003 (JP) ..... 2003-336651

(51) Int. Cl.
*B01F 13/00* (2006.01)

(52) U.S. Cl. ..... 366/162.4; 366/177.1; 366/173.1; 366/341

(58) Field of Classification Search ..... 73/61.56; 366/177.1, 173.2, 341, 181.6, 162.4, 173.1; 422/130; 137/602

See application file for complete search history.

(56) References Cited

U.S. PATENT DOCUMENTS

| | | | | |
|---|---|---|---|---|
| 1,330,174 | A * | 2/1920 | De Cew | 516/53 |
| 2,509,288 | A * | 5/1950 | Brochner | 366/160.2 |
| 3,905,395 | A * | 9/1975 | Hupe | 366/181.8 |
| 4,018,426 | A * | 4/1977 | Mertz et al. | 366/160.3 |
| 4,474,477 | A * | 10/1984 | Smith et al. | 366/165.5 |
| 4,534,659 | A * | 8/1985 | Dourdeville et al. | 366/338 |
| 5,450,743 | A * | 9/1995 | Buote | 73/61.56 |
| 6,655,829 | B1 * | 12/2003 | Vanden Bussche et al. | 366/165.1 |
| 6,982,064 | B1 * | 1/2006 | Ehrfeld et al. | 422/130 |
| 2003/0039169 | A1 * | 2/2003 | Ehrfeld et al. | 366/336 |
| 2004/0145967 | A1 * | 7/2004 | Honda | 366/336 |

FOREIGN PATENT DOCUMENTS

| | | |
|---|---|---|
| DE | WO0076648 A1 * | 12/2000 |
| JP | 06-226071 | 8/1994 |
| JP | 2001-120971 | 5/2001 |
| JP | 2002-346355 | 12/2002 |

* cited by examiner

*Primary Examiner*—Hezron Williams
*Assistant Examiner*—Ryan Christensen
(74) *Attorney, Agent, or Firm*—Antonelli, Terry, Stout and Kraus, LLP.

(57) ABSTRACT

The invention provides a mixer capable of mixing two kinds of liquids with each other while varying a mixing ratio in a wide range of the flow rates thereof by causing the two liquids in trace amounts to come into contact with each other, or a mixer capable of mixing in short time.

The mixer comprises a mixing chamber very low in profile for effecting mixing reaction, and micro-nozzles, provided at a high density in the upper face and lower face thereof, respectively. The mixer is a mixer wherein micro-nozzles are provided in the inner walls of a mixing chamber, respectively, so as to oppose each other, and two liquids are spurted from the micro-nozzles, respectively, thereby implementing mixing by taking advantage of a diffusion phenomenon. Since the two liquids in trace amounts are ejected from the micro-nozzles, respectively, in such a way as to oppose each other, the two liquids in trace amounts come into contact with each other, thereby enabling diffusion mixing in short time.

18 Claims, 12 Drawing Sheets

FIG. 9

| | | | | | |
|---|---|---|---|---|---|
| DIFFUSION ARRIVAL TIME t (s) | 0.1 | 1 | 3 | 10 | 100 |
| DIFFUSION LENGTH d ($\mu$m) | 13 | 41 | 71 | 130 | 410 |
| PITCH P ($\mu$m) (WHEN $\theta$ =45°) | 18 | 58 | 100 | 183 | 580 |
| TOTAL NUMBER OF NOZZLES (pcs.) | 108243 | 34229 | 19763 | 10824 | 3423 |
| TOTAL NUMBER (pcs.) OF NOZZLES IN A LINE | 329 | 185 | 140 | 104 | 59 |
| SIDE LENGTH (mm) OF SQUARE | 6.03 | 10.72 | 14.11 | 19.07 | 33.91 |
| UNIT DIFFUSION REGION V (n1) | 0.003 | 0.10 | 0.51 | 3.079 | 97.4 |
| LINEAR VELOCITY (mm/sec) | 60.3 | 10.72 | 4.70 | 1.91 | 0.34 |
| SHIFT DISTANCE (mm) OF SECTION | 6.03 | 10.72 | 14.11 | 19.1 | 33.9 |
| CHIP LENGTH (mm) | 12.06 | 21.45 | 28.22 | 38.14 | 67.83 |

MIXER AND LIQUID ANALYZER PROVIDED WITH SAME

CLAIM OF PRIORITY

The present application claims priority from Japanese application serial JP 2003-336651 filed on Sep. 29, 2003, the content of which is hereby incorporated by reference into this application.

FIELD OF THE INVENTION

The invention relates to a mixer for effectively mixing fluids in trace amounts with each other, and a liquid analyzer provided with the same.

BACKGROUND OF THE INVENTION

As a conventional mixing reaction apparatus, the mixing reaction apparatus, and the chemical analyzer using the same, disclosed in Japanese Patent Laid-Open No. H6 (1994)-226071, are cited. The mixing reaction apparatus comprises a mixing chamber very low in profile, for executing mixing reaction, a multitude of minute nozzles provided at a high density on the bottom face of the mixing chamber, means connected to the minute nozzles, for feeding a liquid A (reagent), and a sample suction pump for sucking a liquid B (sample) into the mixing chamber, or feeding the mixing chamber with a cleaning liquid. Because reaction between the liquid B (the sample) as taken and the liquid A (the reagent) is instantaneously attained, a process of chemical reaction in which uniform mixing occurs and reaction takes place at a high-speed is measured on uniform concentration conditions.

Further, as another mixer, the liquid mixer, as disclosed in Japanese Patent Laid-Open No. 2001-120971, is cited. With the liquid mixer, respective liquid dividing narrow grooves for dividing a liquid A and a liquid B, as targets for mixing, introduced through a liquid inlet, and liquid mixing narrow grooves where branch flow paths of the respective liquid dividing narrow grooves are alternately linked with each other are formed in respective nesting faces of two plates, individually. In the liquid mixing narrow groove, the liquids A, B, in thin layers, respectively, are alternately stacked in the direction of the depth of the grooves, and are adjacent to each other, so that diffusion between the liquids A, B proceeds rapidly, and trace amounts of the respective liquids are mixed before flowing out of a liquid outlet.

Furthermore, as still another mixer, the micro-mixer, as disclosed in Japanese Patent Laid-Open No. 2002-346355, is cited. With the mixer, in a cell prepared by nesting and bonding a cell substrate and a cover together, an etching process is applied to the upper face of the cell substrate to thereby form respective inlet flow paths corresponding to liquids A, B, mixing flow paths, and an outlet flow path for a mixed liquid C.

[Patent Document 1]
Japanese Patent Laid-Open No. H6(1994)-226071

[Patent Document 2]
Japanese Patent Laid-Open No. 2001-120971

[Patent Document 3]
Japanese Patent Laid-Open No. 2002-346355

However, the inventors have found out that the embodiments disclosed in the above-described literature on the related art are not satisfactory for effectively mixing trace amounts of liquids. If the mixing reaction apparatus is applied to a gradient mixer (the gradient mixer is a mixer for mixing two kinds of solvent liquids while varying a mixing ratio thereof) installed mainly in a micro-LC (liquid chromatography), the following s are cited as problem points. When mixing two liquids at a minute flow rate, if a ratio of a flow rate of a liquid A to that of a liquid B is varied, for example, in case the flow rate of the liquid A is not less than 5 times the flow rate of the liquid B, there is a risk of occurrence of a problem in that the liquid B is not mixed with the liquid A, stagnation occurs, or so forth, in the mixing chamber of the mixing reaction apparatus described above, due to difference in flow velocity between the two liquids.

Further, a similar problem also occurs to the mixer described above if applied to the gradient mixer, and if a mixed solvent liquid from the mixer is injected into a column, which is a constituent component of a liquid chromatography, with two liquids in a state yet to be sufficiently mixed with each other, there has been encountered a problem that chemical components in liquid phase cannot be satisfactorily separated, resulting in failure to detect the chemical components with high precision in a subsequent process.

SUMMARY OF THE INVENTION

It is therefore an object of the invention to provide a mixer for effectively mixing fluids in trace amounts with each other, and a liquid analyzer provided with the mixing mechanism of the mixer.

The invention resolves at least one of the problems described in the foregoing.

(1) A mixer according to the invention comprises a feeder for a first liquid, a feeder for a second liquid, first nozzles formed in a first base plate having a plurality of spouts for the first liquid, second nozzles formed in a second base plate having a plurality of spouts for the second liquid, and a mixing unit for mixing the first liquid spurted from the first nozzles with the second liquid spurted from the second nozzles.

For example, the first base plate may be disposed opposite to the second base plate with the mixing unit interposed therebetween.

With the adoption of such a construction as described, it is possible to provide the mixer wherein by use of the first nozzles having the plurality of spouts, for feeding the mixing unit with the first liquid, and the second nozzles having the plurality of spouts, for feeding the mixing unit with the second liquid, the two liquids are ejected from the first nozzles and second nozzles, respectively, thereby implementing effective mixing in short time by taking advantage of a diffusion phenomenon.

Further, as a specific form, the mixing unit preferably has a discharge path for a mixed liquid after mixed in the mixing unit, formed between both the first base plate and the second base plate.

Further, the mixer according to the invention may comprise a feeder for a first liquid, a feeder for a second liquid, first nozzles communicating with the feeder for the first liquid, having a plurality of spouts for the first liquid, second nozzles communicating with the feeder for the second liquid, having a plurality of spouts for the second liquid, formed so as to oppose the spouts for the first liquid, wherein a mixing unit for mixing the first liquid spurted from the first nozzles with the second liquid spurted from the second nozzles is disposed in a region between the first nozzles and the second nozzles.

(2) With those mixers, a position reached by extending a spurting direction of a first spout for the first liquid toward the second base plate may fall between a first spout for the second liquid and a second spout for the second liquid.

Thus, if the first nozzles and second nozzles are disposed so as to oppose each other in a staggered configuration with the mixing unit interposed therebetween, this is preferable from the viewpoint of attaining efficient mixing.

Further, depending on circumstances due to the form of the mixer, the first nozzles and second nozzles may be disposed in the same direction in a staggered configuration with the mixing unit interposed therebetween.

Further, as still another form of the invention, with any of the mixers described above, the feeder for the first liquid may have a first feed path for feeding the first liquid, and a first feed header communicating with the first feed path and the plurality of spouts for the first liquid, and the first feed header is formed smaller in volume than the mixing unit. With this arrangement, it is possible to enhance response characteristics and mixing performance.

Otherwise, with any of the mixers described above, the feeder for the first liquid may have a first feed path for feeding the first liquid, and a first feed header communicating with the first feed path and the plurality of spouts for the first liquid, and the first feed header has a first region communicating with the first feed path, and a second region communicating with the fist region via a plurality of feeders of the first liquid, and communicating with the spouts for the first liquid. With this constitution, it is possible to enhance mixing characteristics by reducing difference in spurting characteristics among the respective spouts. Further, with those features, a region for a junction part between the fist region and the second region is preferably formed so as to be wider than a region for a junction part between the first feed path and the fist region.

(3) In another aspect of the invention, there is provided a mixer wherein a plurality of mixing units are effectively operated. The mixer comprises a first feeder for a first liquid, a second feeder for the first liquid, a feeder for a second liquid, formed between the first feeder for the first liquid and the second feeder for the first liquid, a first mixing unit formed between the first feeder for the first liquid and the feeder for the second liquid, and a second mixing unit formed between the second feeder for the first liquid and the feeder for the second liquid.

Still further, the first mixing unit or the second mixing unit preferably comprises a first base plate having a plurality of spouts for spurting the first liquid, formed therein a second base plate having a plurality of spouts for spurting the second liquid, formed therein, and a mixing chamber formed between the first base plate and the second base plate, for mixing the first liquid with the second liquid.

Thus, it is possible to increase a mixing volume by effectively stacking a plurality of the mixing chambers to thereby widen a range of the flow rates of a mixed liquid. In addition, high pressure resistance can be obtained by stacking a multitude of the mixing chambers.

(4) In still another aspect of the invention, there is provided a liquid analyzer comprising an injector for injecting a sample into a solvent, a column into which the sample and the solvent are introduced from the injector to thereby separate components of the sample, and a detector for detecting the components of the sample as separated, discharged from the column, said liquid analyzer further comprising a feeder for a first solvent liquid, a feeder for a second solvent liquid, first nozzles formed in a first base plate, having a plurality of spouts for the first solvent liquid, second nozzles formed in a second base plate, having a plurality of spouts for the second solvent liquid, and a mixing unit for mixing the first solvent liquid spurted from the first nozzles with the second solvent liquid spurted from the second nozzles, wherein the solvent is a mixed solvent discharged from the mixing unit.

The liquid analyzer may be in the form of, for example, a liquid chromatography, however, the invention is not limited thereto if it is an analyzer using a mixed liquid, such as one comprising the mixer described.

Or a liquid analyzer may comprise the injector for injecting the sample into the solvent, the column into which the sample and the solvent are introduced from the injector to thereby separate components of the sample, the detector for detecting the components of the sample as separated, discharged from the column, and said liquid analyzer further comprises a first feeder for a first solvent liquid, a second feeder for the first solvent liquid, a feeder for a second solvent liquid, formed between the first feeder for the first solvent liquid and the second feeder for the first solvent liquid, a first mixing unit formed between the first feeder for the first solvent liquid and the feeder for the second solvent liquid, and a second mixing unit formed between the second feeder for the first solvent liquid and the feeder for the second solvent liquid.

With the adoption of such forms as described in the foregoing, the invention can provide a mixer for effectively mixing fluids in trace amounts with each other, and a liquid analyzer provided with the mixing mechanism of the mixer.

The invention can provide the mixer capable of diffusion mixing in short time even if a mixing ratio of two kinds of liquids is varied, and a range of the flow rates of the two liquids is widened because the two liquids in trace amounts come into contact with each other by causing the two liquids in trace amounts to be ejected from micro-nozzles, respectively, in such a way as to oppose each other(or in the same direction).

Further, with the embodiments of the invention, it is possible to widen a range of the flow rate of a mixed liquid as discharged, enabling excellent mixing even if a mixing ratio is altered. Still further, changeover of a range of the flow rates of liquids can be selected by use of valves such that a mixing volume can correspond to a target flow rate.

Thus, the invention is suitable for application to a mixer for effectively mixing liquids particularly, such as a trace amount of a sample liquid, solvent liquid, and so forth, respectively, in short time, a chemical reaction apparatus for causing chemical reaction to occur, or a chemical analyzer for causing different kinds of liquids to undergo mixing reaction to thereby analyze the nature thereof.

With the adoption of such forms as described in the foregoing, the invention can provide a mixer for effectively mixing fluids in trace amounts with each other, and a liquid analyzer provided with the mixing mechanism of the mixer.

BRIEF DESCRIPTION OF THE DRAWINGS

FIG. 9 is a table showing mixer specifications by way of example;

DETAILED DESCRIPTION OF THE PREFERRED EMBODIMENTS

Embodiments of a mixer according to the invention are described hereinafter. It is to be understood, however, that the invention is not limited to forms described in the embodiments and that any changes or variations based on the related art, bringing about the equivalent object and operation effects, may be made in the invention without departing from the spirit and scope thereof. Now, a liquid chromatography provided with the mixer according the invention is described by way of example hereinafter.

Figure 1:
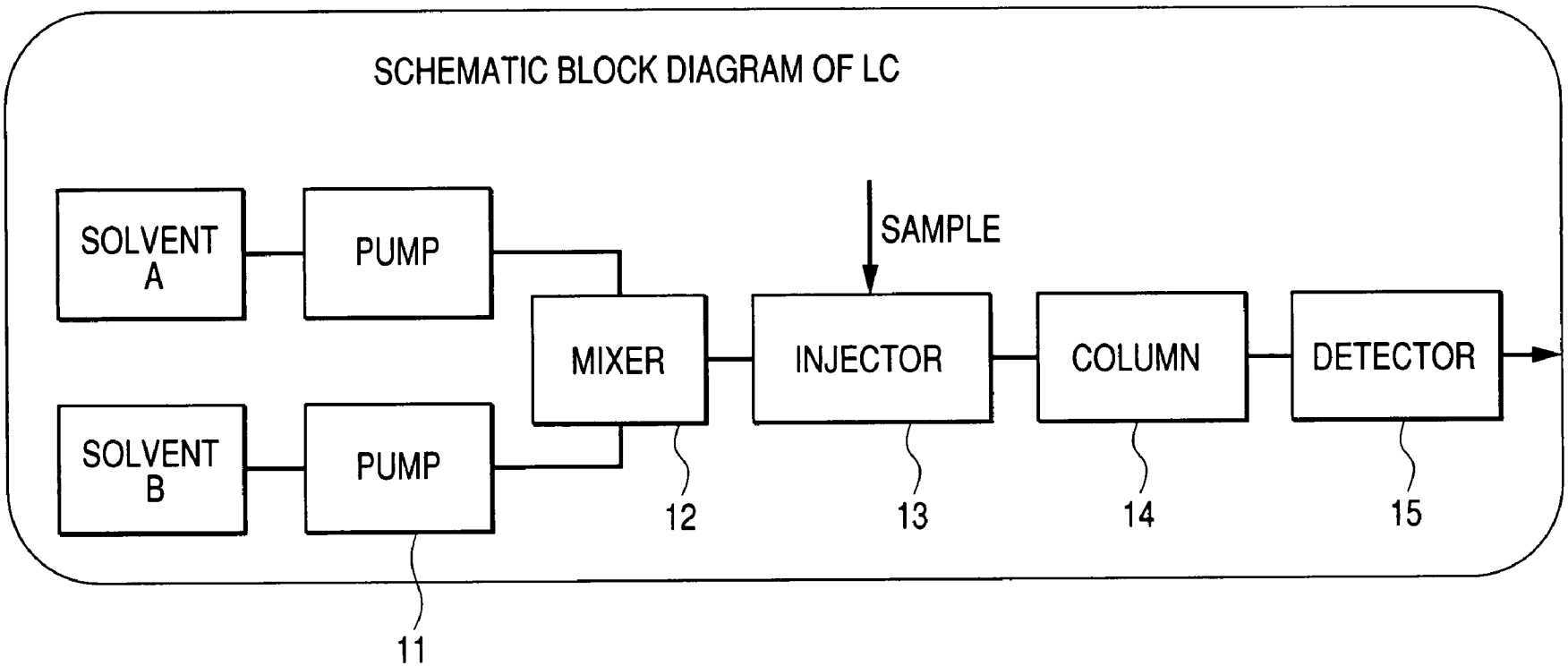
FIG. 1 is a schematic representation of a micro-liquid chromatography.

A first embodiment of the invention is described with reference to FIGS. 1 to 4. FIG. 1 is a schematic representation of a micro-liquid chromatography as an example of a liquid analyzer, and FIGS. 4A and 4B are schematic representations showing the constitution of a micro-mixer, representing the mixer according to the present embodiment.

Figure 4B:
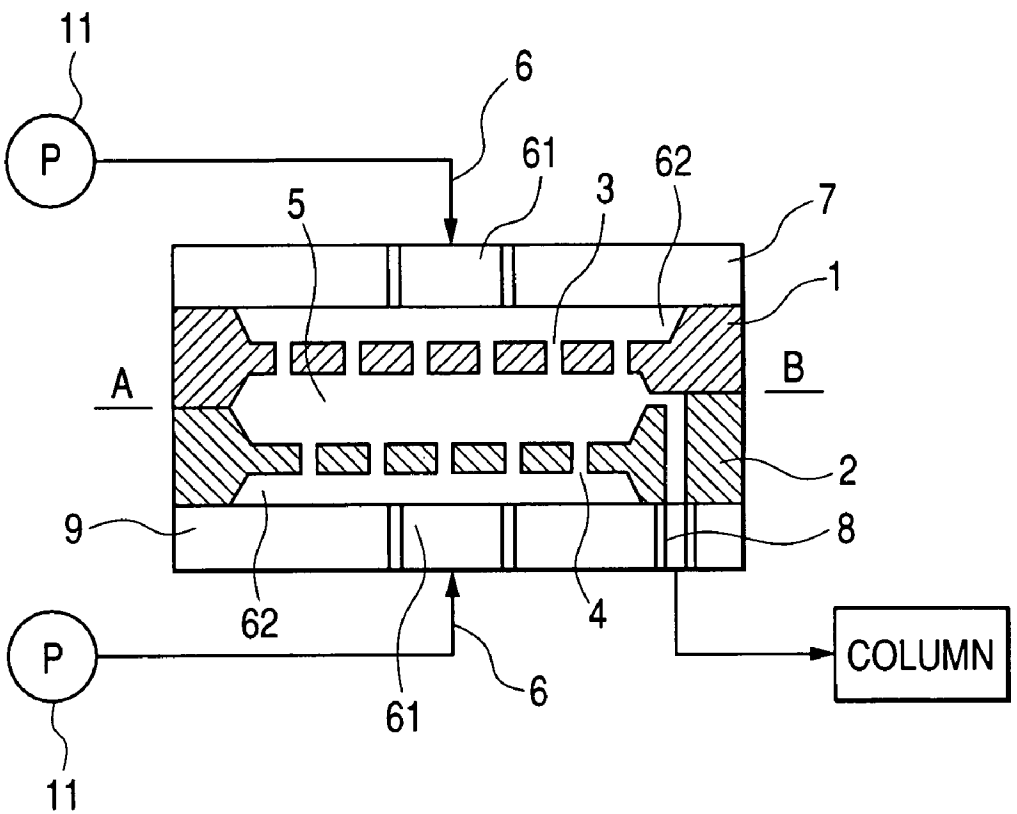
FIGS. 4A and 4B are schematic representations showing a first embodiment of the invention.
Figure 4A:
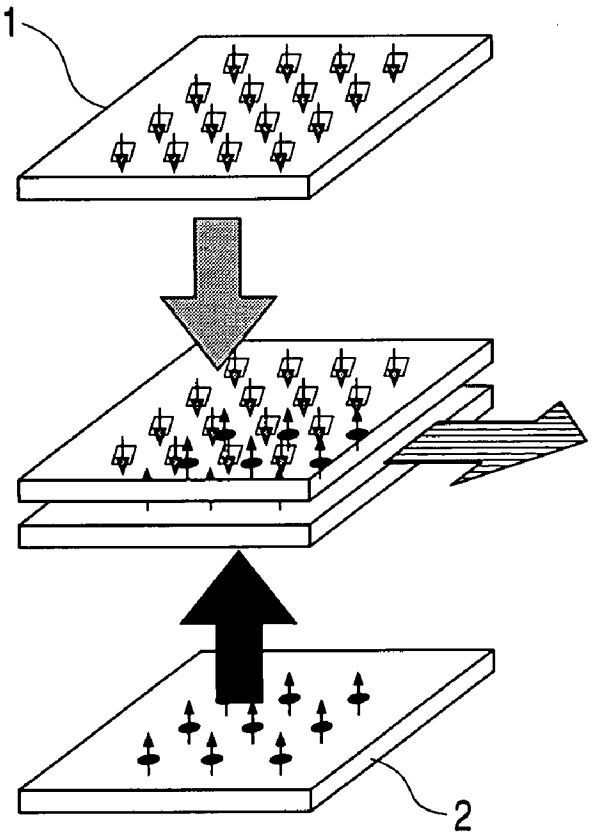

As shown in FIGS. 4A and 4B by way of example, the mixer used in this case comprises a feeder 6 for a solvent A as a first liquid, a feeder 6 for a solvent B as a second liquid, a mixing chamber 5 serving as a mixing unit into which these liquids are fed, further having first nozzles having a plurality of spouts 3, for feeding the first liquid to the mixing unit, and second nozzles having a plurality of spouts 4, for feeding the second liquid to the mixing unit. The first nozzles and second nozzles are disposed so as to oppose each other with the mixing unit interposed therebetween. Further, the first nozzles and second nozzles are disposed so as to oppose each other in a staggered configuration with the mixing unit interposed therebetween (further, another form may be adopted wherein the first nozzles and second nozzles may be disposed in the same direction in a staggered configuration with the mixing unit interposed therebetween).

As to a mixed liquid as discharged, a range of low rates can be widened, mixing can be implemented even if a mixing ratio of the liquids is changed, and even if the liquids are at minute flow rates, mixing can be implemented effectively.

An LC (liquid chromatography) is an apparatus for separating chemical components in liquid phase by use of a column so as to be able to identify the chemical components by color. In particular, a chromatography employing a column minute in diameter is called a micro-chromatography. The purpose of the micro-chromatography is for application to separation of compounds that cannot be separated by an ordinary column to thereby separate and analyze compounds in trace amounts.

FIG. 1 is a schematic block diagram thereof. Two kinds of liquids are fed into a mixer 12 by use of pumps 11 corresponding to solvent liquids A, B, respectively. The two kinds of liquids are mixed inside the mixer 12 where pressure is applied at about 300 atm. Subsequently, a pressurized mixed liquid made of the two kinds of liquids reaches a column 14 via an injector 13 (a sample injector). The column 14 has a filling material therein (for example, silica gel in a very fine powder form [about 10 μm in grain size] is filled). Herein, compounds are separated and a detector 15 detects chemical components as targets for detection from the mixed liquid discharged from the column. The present embodiment represents a micro-liquid chromatography. The micro-liquid chromatography according to the present embodiment is provided with a gradient mixer. The gradient mixer is a mixer for mixing by varying a mixing ratio of two kinds of solvent liquids to be injected into a column where chemical components in liquid phase are separated. By varying the mixing ratio, multiple kinds of chemical components can be separated, enhancing precision in detection of the chemical components.

Recently, as research and development (on creation of medicine, and gene diagnosis) in the age of post-genome-sequence, there is proteome analysis, and the needs for this analysis have been on the increase. However, when cells are collected and protein is extracted, the protein as extracted is in an extreme trace amount and cannot be multiplied unlike DNA. Accordingly, techniques for handling an extreme trace amount of liquid are required in the development of the micro-LC for the proteome analysis, capable of coping with an extreme trace amount of sample. As a result, there is the need for a mixer capable of coping with fluids in extreme trace amounts, and an analyzer provided with the same.

With the mixer, two liquids are spurted through nozzles, respectively, thereby taking advantage of a diffusion phenomenon. A mixing volume is calculated based on a unit diffusion region per one piece of nozzle from a target flow rate, thereby specifying the number of the nozzles.

Further, in this case, it is intended that water and methanol as the two kinds of the liquids are mixed with each other and a specification of the mixer is obtained from diffusion time as a design standard for the mixer taking advantage of the diffusion phenomenon.

With the mixer taking advantage of the diffusion phenomenon by spurting the two liquids through the nozzles, respectively, the mixing volume is calculated based on the unit diffusion region per one piece of nozzle from the target flow rate, thereby specifying the number of the nozzles.

Figure 2:
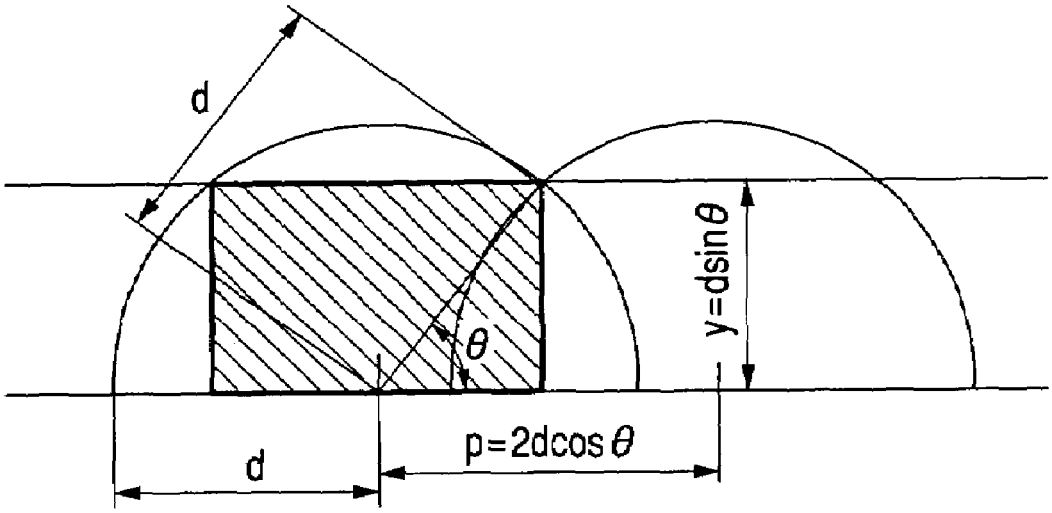
FIG. 2 is a sectional view of a unit diffusion region for use when designing a mixer.
Figure 3:
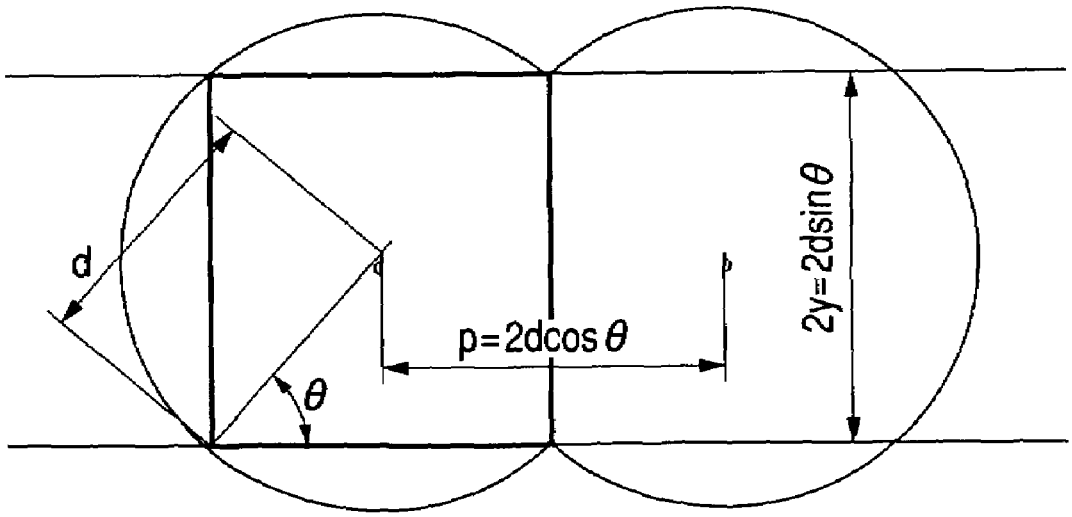
FIG. 3 is a plan view of the unit diffusion region for use when designing the mixer.

A designing method is briefly described hereinafter. Assuming that time for ejecting a liquid (methanol) from nozzles into a mixing chamber is equal to diffusion time, the number of the nozzles, necessary for mixing, can be obtained. As shown in FIG. 2, a length for the liquid (methanol) undergoing diffusion from the nozzle to the mixing chamber (filled up with water) is deemed to be a height of the mixing chamber. The number of the nozzles is calculated by dividing the target flow rate (volume) by the unit diffusion region. As shown in FIGS. 2 and 3, the unit diffusion region is a diffusion region per one piece of the nozzle, when the nozzles are adjacent to each other, among regions obtained from a hemisphere model centering around the nozzle, with a diffusion length adopted as its radius. A calculation procedure for the design specification of the mixer is shown hereinafter.

(1) Calculation of a Diffusion Length

Assuming that a length for diffusion from a nozzle is d (mm), diffusion coefficient of methanol to water is D ($mm^2$/sec)=$8.4\times10^{-4}$, and diffusion arrival time is t (s)=0.1, 1, 3, 10, 100, a diffusion length is generally estimated by the following formula according to Fick's law:

$$\text{diffusion length } (d)=\sqrt{(2Dt)}$$

(2) Calculation of a Nozzle Pitch

The volume of a unit diffusion region (a diffusion region per one piece of nozzle when nozzles are adjacent to each other: a diagonally shaded area) is at the maximum if θ=45°, in which case, a pitch P (mm) between the adjacent nozzles at respective diffusion times is obtained by the following formula:

$$\text{nozzle pitch } P(\text{mm})=2d\cos\theta=\sqrt{2}d(\text{if } \theta=45°)$$

(3) Calculation of the Volume of a Unit Diffusion Region

The volume V (nl) of a unit diffusion region is obtained by the following formula:

$$\text{unit diffusion region: } V=4d^3\sin^2\cos\theta=\sqrt{2}d^3(\text{if } \theta=45°)$$

(4) Calculation of the Number of Nozzles

Assuming that a flow rate of a liquid flowing into a mixing chamber is Q, the total number N (pcs.) of nozzles is obtained by the following formula:

$$\text{the total number } N(\text{pcs.})=Q\cdot t+V$$

where a flow rate in the mixer Q=0.1 to 200 μl/min, and diffusion arrival time t (s)=0.1, 1, 3, 10, and 100, respectively.

(5) Calculation of One Side Length of the Mixer

Assuming that nozzles are disposed in a matrix arrangement, one side length L of the mixer is obtained by the following formula:

$$\text{one side length } L(\text{mm}) \text{ of the mixer}=P(\text{mm})\times\sqrt{N}(\text{pcs.})$$

(6) Average Velocity in the Mixer

When a flow rate in the mixer is Q (μl/s) (when the maximum target flow rate is at 200 μl/min), average velocity v (mm/s) is obtained by the following formula:

$$\text{average velocity } v=Q/(S/2)$$

where cross section S ($mm^2$) of a diffusion region where liquids are fully mixed=the nozzle pitch P (mm)×the one side length L (mm) of the mixer (7) Shift Distance of a Diffusion Region A shift distance L' (mm) of a diffusion region is obtained by the following formula:

$$\text{shift distance } L'(\text{mm})=v\cdot t$$

(8) Chip Length (mm)

A chip length L" (mm) is obtained by the following formula. The chip length represents a distance necessary for mixing of two liquids before discharged from a mixing chamber:

$$\text{chip length } L''(\text{mm})=\text{one side length } L(\text{mm}) \text{ of a square}+\text{shift distance } L'(\text{mm})$$

In the case where calculation is made based on the procedure described above on the assumption that the diffusion time (as the diffusion arrival time) is 0.1, 1, 3, 10, and 100 (s), respectively, and the flow rate of liquids flowing into the mixer is the maximum target flow rate at 200 μl/min, relationship between the diffusion time and the specification of the mixer is shown in FIG. 9.

From the viewpoint of rapidity in mixing, the diffusion time is preferably shorter. In the case of the diffusion time being 0.1 (s), however, the pitch needs to be fairly small. Accordingly, the diffusion time longer than 0.1 (s) is preferable from the viewpoint of manufacturing ease. Further, in the case of the diffusion time being 100 (s), the volume increases, requiring longer mixing time. Accordingly, the diffusion time less than 100 (s) is preferable from the viewpoint of manufacturing ease, and attaining rapidity in mixing. Needless to say, the above does not apply if emphasis is to be placed on viewpoints other than the above-described viewpoints from manufacturing ease, and so forth.

FIGS. 4A and 4B show the mixer according to the present embodiment by way of example. FIG. 4A is a perspective illustration broadly showing the whole form thereof, and FIG. 4B is a sectional view specifically showing the construction thereof. As shown in FIG. 4A, a multitude of nozzles are formed in an upper base plate 1 and a lower base plate 2, respectively, and a liquid is spurted through the nozzles formed in the respective base plates into a mixing chamber interposed between the base plates. Described hereinafter is a specific form wherein the nozzles are disposed on the inner wall of the mixing chamber, on the upper and lower face sides thereof, respectively, so as to oppose each other. The first liquid is fed from a plurality of upper face side (first) nozzles 3 formed in the upper base plate 1 made of silicon, and the second liquid is fed from a plurality of lower face side (second) nozzles 4 formed in the lower base plate 2 made of silicon. The solvent A is fed from the pump 11 to the upper face side nozzles of the upper base plate 1, and the solvent B is fed from the other pump 11 to the lower face side nozzles of the lower base plate 2. The solvents mixed in the mixing chamber 5 are guided to outside through an outflow guide path 8. In this case, a flow path through which the mixing chamber 5 communicates with the injector 13 and the column 14 is formed so as to be linked therewith from between the upper base plate 1 and the lower base plate 2. The liquid fed from the pump 11 is guided into the mixing chamber 5 from the feeder 6 via the nozzles 3 or the nozzles 4. Further, the feeders 6 each have a feed header 62 for delivering the liquid to a flow path 61, and communicating with the nozzles 3 or the nozzles 4, so as to distribute and guide the liquid to the plurality of nozzles 3 or nozzles 4.

One of the feed headers 62 is formed in a space sandwiched between the upper base plate 1 and a mixer holder upper plate 7. Further, the other of the feed headers 62 is formed in a space sandwiched between the lower base plate 2 and a mixer holder lower plate 9. Thus, it becomes possible to manufacture the mixer taking advantage of the diffusion phenomenon by injecting the two liquids through the upper face side nozzles, and the lower face side nozzles, respectively. In this case, there are provided the base plates opposing each other, constituting the inner wall of the mixer, and the nozzles for the first liquid are formed in the base plate on one side while the nozzles for the second liquid are formed in the base plate on the other side. The mixing unit for the liquids is formed between both the base plates.

Further, a discharge path for the liquids mixed in the mixing unit is configured so as to communicate with other components of the apparatus through between both the base plates. Accordingly, a mixed liquid in an excellent mixed condition can be fed.

Since the mixing volume of the mixer is calculated based on the unit diffusion region per one piece of the nozzle from the maximum target flow rate to thereby find the number of the nozzles, the mixer is capable of implementing diffusion mixing in short time because the two liquids in trace amounts are ejected in such a way as to oppose each other from micro-nozzles, respectively, thereby causing the two liquids in trace amounts to come into contact with each other. Further, by staggering the positions of the nozzles disposed on the lower side and the positions of the nozzles disposed on the upper side, the effect of convection in the mixing chamber is enhanced, which is effective in shortening mixing time. Further, the positions of the nozzles on the lower side and the positions of the nozzles on the upper side may be disposed in a staggered configuration, or in the same direction.

Furthermore, the mixer is capable of widening the range of flow rates, and since the mixing volume of the mixer is obtained from the maximum target flow rate, the mixer is capable of mixing even if a mixing ratio is changed provided a flow rate is below the target flow rate.

Figure 5:
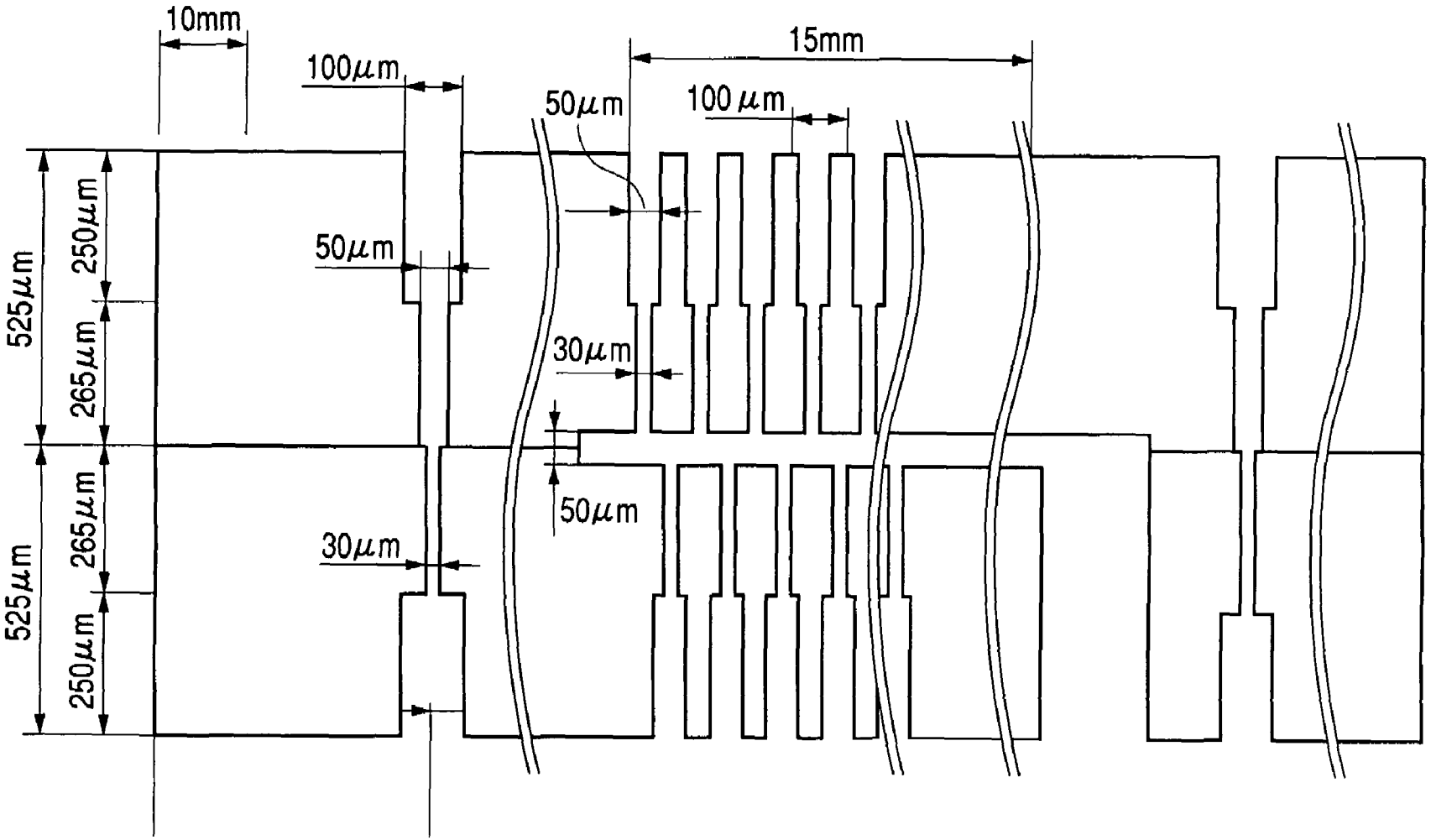
FIG. 5 is another schematic representation showing the first embodiment of the invention.

As shown in FIGS. 4A and 4B, the mixer has the mixing chamber 5 low in profile, and the wall face part thereof is provided with a multitude of the micro-nozzles. The micro-nozzles are linked with a feed path 61 for reagent. The reagent is spurted out of the micro-nozzles into the mixing chamber 5. Since the mixing chamber is small in thickness, jet flows of the reagent are spread thicknesswise throughout the mixing chamber 5, and further, diffusion of molecules, in the lateral direction thereof, occurs rapidly, thereby attaining rapid mixing in the mixing chamber 5. These nozzles 3, 4 are worked on by, for example, the fine patterning technology, such as etching, and so forth, applied in the manufacture of semiconductors. With the use of the technology, in the case of using the design value for the diffusion time at 3 seconds from Table shown in FIG. 9, by arranging nozzles each in the shape of a square with a side length about 30 μm at pitches of 100 μm, a mixing chamber on the order of 50 μm×15 μm×15 μm in size can be fabricated, thereby enabling 20,000 pcs. of the nozzles to be disposed in the bottom face thereof. FIG. 5 is a sectional view of a prototype mixer fabricated based on a target flow rate at 20 μl/min, using the design value for the diffusion time at 3 seconds. In the case of, for example, causing the liquids to flow at a high pressure, the width of a nozzle, on the side thereof, adjacent to a spout, is preferably rendered smaller than that on the side thereof, away from the spout, as shown in FIG. 5. With this, in the case of increasing plate thickness in order to ensure pressure resistance, it is possible to form flow paths having a very high aspect ratio with high precision. Further, even in the cases other than the case of causing the liquids to flow at a high pressure, such a configuration as described is adequate for use in the case of increasing the plate thickness from the viewpoint of strength and others.

Figure 7:
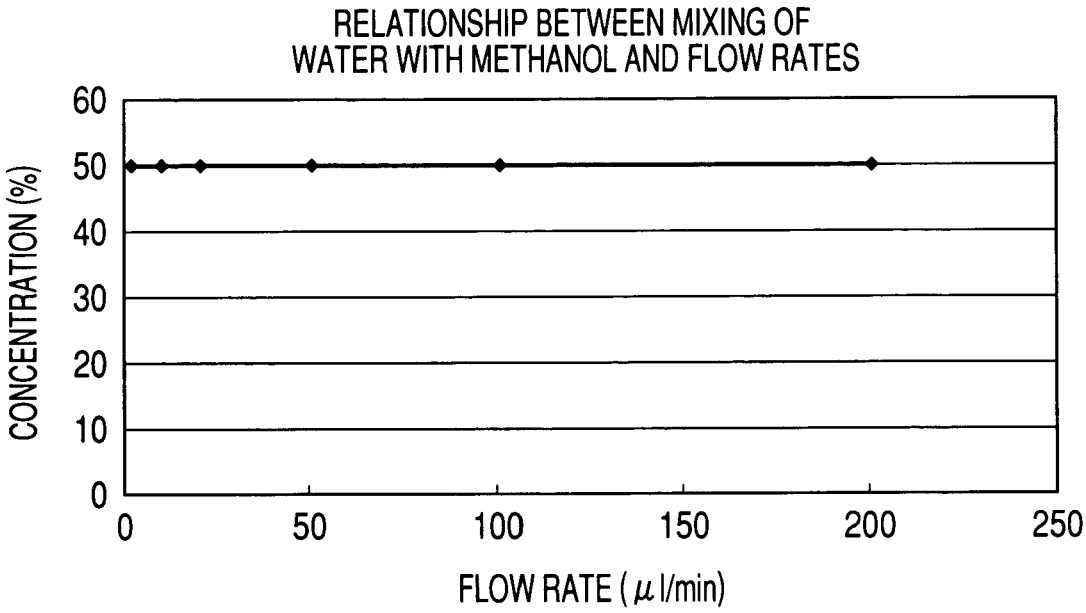
FIG. 7 is a diagram showing results of a test conducted on a prototype mixer.

With the mixer, the mixing chamber is 50 μM high, and is in the shape of a disc, with a bottom face in the shape of a circle about 15 mm in diameter, and about 2000 pcs. of square nozzles each 30×30×50 μm in size are disposed in a matrix arrangement at pitches of 100 μm on the upper and lower wall faces of the mixing chamber, respectively. The nozzles on the upper side and the nozzles on the lower side are staggered by 50 μm, respectively. The mixer is designed on a stationary flow basis, and accordingly, in order to check whether or not the two liquids mix well, a test using the prototype mixer was conducted. FIG. 7 shows results of the test, indicating methanol concentration at a point in time after the passage of 10 seconds. The test was conducted on a condition that methanol was injected into the mixing chamber from the nozzles on the upper side and water was injected into the mixing chamber from the nozzles on the lower side concurrently. As shown in FIG. 5, a discharge outlet was provided on the right-hand side of the mixing chamber. Flow rates for the two liquids, respectively, were kept at the same rate. It is evident from a graph in FIG. 7 that the two liquids mixed well since the methanol concentration remained on the order of 50% even though a flow rate was varied. It was thus confirmed from the above that the invention is useful.

Figure 6:
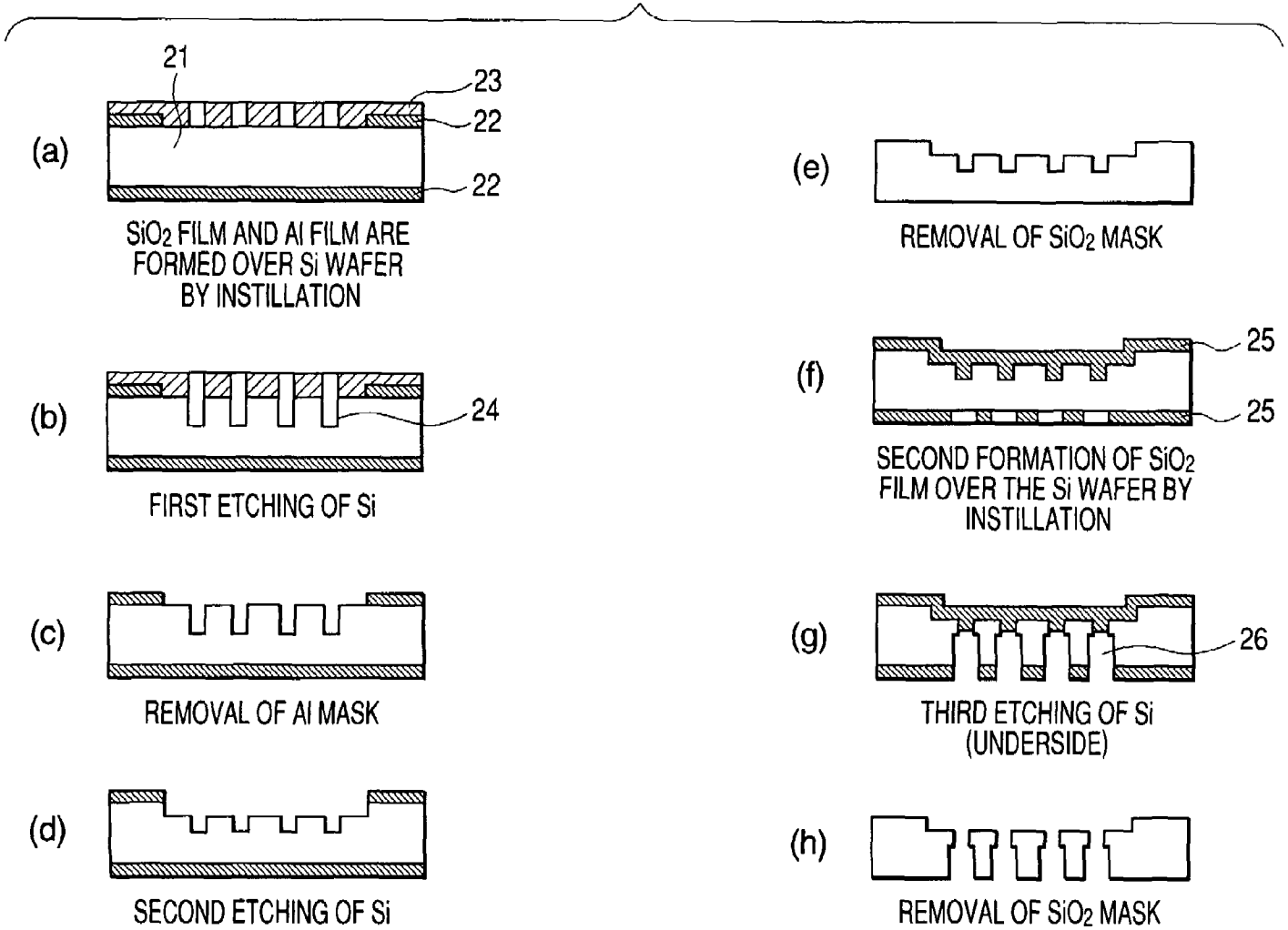
FIG. 6 is a schematic representation showing the steps of fabricating the mixer according to the first embodiment of the invention.

Now, FIG. 6 shows the steps of fabricating the mixer according to the first embodiment of the invention. In FIG. 6, the upper side of a wafer in section shows the inner side in the mixing chamber, and the lower side thereof shows the outer side in the mixing chamber. In a step (a), an oxide film 22 is formed on a silicon (Si) substrate 21 to prepare an $SiO_2$ etching mask. By developing the image of a mixing unit on the inner side of the mixing chamber and patterning in the image for removal, the $SiO_2$ etching mask exposing the silicon substrate, in predetermined regions, is prepared. An Al film 23 is formed on a face of the wafer, adjacent to the inner side of the mixing chamber. In this case, sputtering with Al is applied. Thereafter, an Al etching mask with a multitude of holes defined by patterning is formed. The procedure of fabrication, hereafter, is as shown in the figure, and in a step (b), dry etching is applied to a depth substantially equivalent to about half of the thickness of the wafer in order to form portions of nozzles, on the inner side of the mixing chamber. Subsequently, as shown in a step (c), an $SiO_2$ etching mask is formed similarly to develop the image of the mixing chamber. Moore specifically, the Al etching mask is removed to thereby expose portions of the $SiO_2$ etching mask, around respective regions of the holes 24. Then, as shown in a step (d), a second etching of Si is executed to thereby etch portions of the silicon (Si) substrate 21 to a depth corresponding to a midpoint (for example, to a depth about 25 μm) of the depth of the holes defined as above. Subsequently, as shown in a step (e), the oxide films 22 serving as an etching mask, respectively, are removed. Thereafter, as shown in a step (f), an $SiO_2$ film 25 is formed on both side faces of the silicon substrate 21 by instillation. By patterning portions of the $SiO_2$ film 25, on the outer side of the mixing chamber, at positions corresponding to the holes 24, respectively, holes 26 are defined to thereby expose the silicon substrate 21. Subsequently, portions of the silicon substrate 21, corresponding to the holes 26, are etched from the face of the silicon substrate 21, on the outer side of the mixing chamber, thereby linking the holes 26 with the holes 24. With this, a nozzle part can be formed. The holes 24 are defined so as to be smaller in diameter than the holes 26.

Further, changeover of the range of flow rates of liquids into the respective nozzles can be selected such that the mixing volume can correspond to the target flow rate by controlling the driving of the respective motors 11 shown in FIGS. 4A and 4B. This also can be executed by use of valves (not shown) disposed in the respective flow paths.

With the mixer as described, and a liquid analyzer provided with the same, it is possible to mix two kinds of liquids at a flow rate in a wide range while varying a mixing ratio thereof by bringing the two liquids in trace amounts into contact with each other. In addition, mixing can be implemented in short time without an extra mixing mechanism externally provided. Accordingly, it is easy to execute transfer, and so forth, of targets for measurement in a column, so that improvement on analysis time and analysis performance can be attained.

Figure 8:
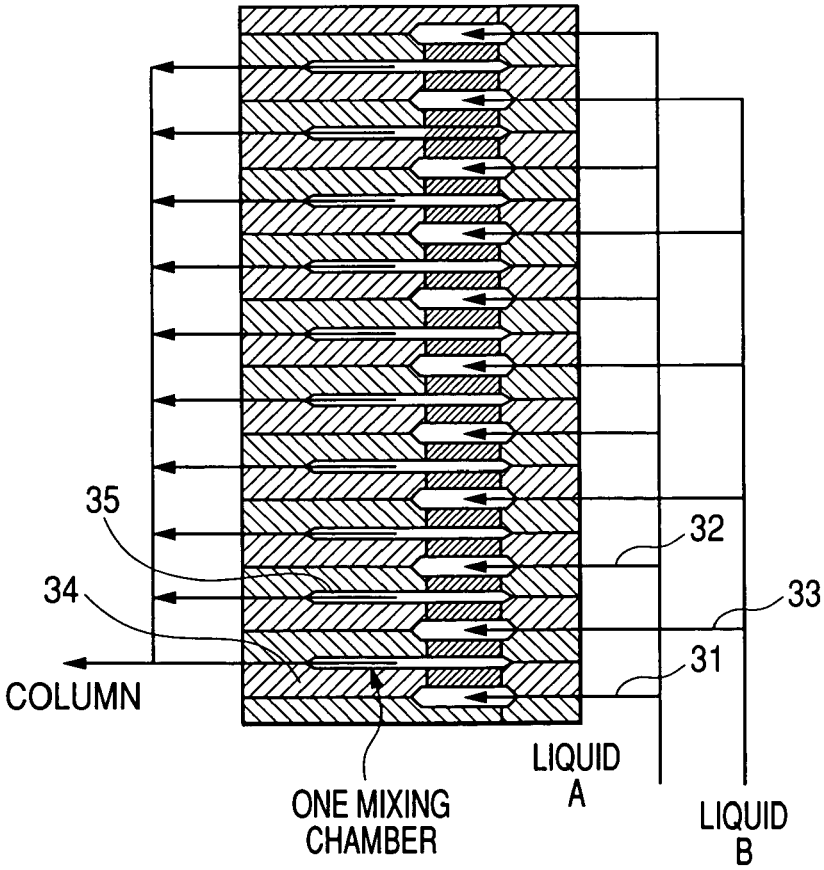
FIG. 8 is conceptual view of a stacked mixer according to a second embodiment of the invention.

Now, a second embodiment of the invention is described hereinafter with reference to FIG. 8. With the second embodiment, the basically same form as described with reference to the first embodiment can be used, but with the second embodiment, use is made of a mixer comprising a plurality of mixing chambers.

The mixer comprises a first feeder 31 for a solvent A, a second feeder 32 for the solvent A, a feeder 33 for a solvent B, formed between the first feeder 31 for the solvent A, and the second feeder 32 for the solvent A, further having a first mixing unit 34 formed between the first feeder 31 for the solvent A, and the feeder 33 for the solvent B, and a second mixing unit 35 formed between the second feeder 32 for the solvent A and the feeder 33 for the solvent B.

As for the specific construction of the respective mixing units, the same form as described with reference to the first embodiment can be used.

With the present embodiment, a mixing volume can be increased by stacking up plurally the mixing chambers, thereby enabling a range of flow rates of a mixed liquid to be widened. Further, as a result of stacking up a multitude of the mixing chambers, it becomes possible to obtain high pressure resistance.

With a liquid chromatography, when a sample is injected into its column, a high pressure in a range of about 300 to 500 atm. is applied thereto, so that an internal pressure in a range of about 300 to 500 atm. is applied also to the wall face of a silicon wafer, which is the wall of the mixing chamber. In FIG. 5, pressure difference in the vertical direction, due to the internal pressure in the mixing chamber, can be coped with by applying a sealing material to the feeder for feeding the liquid to the mixing chamber. Meanwhile, the internal pressure in the range of about 300 to 500 atm. is applied to the wall face of the silicon wafer, in the horizontal direction, in which case, a sealing material cannot be applied thereto for structural reasons, so that pressure resistance can be maintained by increasing the wall thickness of the wall. However, when an etching work is employed, there are limitations to the size of a silicon wafer that can be worked on, resulting in limitations to the size of the mixing chamber as well, posing a problem that it is difficult to expand the rage of flow rates. The structure of the mixing chamber shown in FIG. 5, described with reference to the first embodiment, is designed by taking pressure resistance into account, however, the target flow rate being at 20 μl/min, the rage of flow rates is narrow. Accordingly, by adoption of, for example, a mixing chamber construction, as shown in FIG. 8, wherein the mixing chambers each capable of the target flow rate at 20 μl/min are stacked up in ten stages, the volume of the mixing chambers as a whole can be increased, and the range of the flow rates can be expanded to a range of 1 to 200 μl/min. The range of the flow rates can be changed over by use of valves (not shown), and so forth. Depending on a flow rate, selection of changeover up to ten stages can be made. Further, as a result of stacking up the mixing chambers, the pressure difference can be coped with without changing the wall thickness of the walls of the respective mixing chambers each capable of the target flow rate at 20 μl/min. At the time of stacking, anodic bonding with a glass interposed between the silicon wafers is effectively implemented.

In assembling a mixer, two silicon (Si) wafers provided with nozzles are bonded together, and anodic bonding with silica ($SiO_2$: glass) interposed between the silicon (Si) wafers is executed. To briefly describe the anodic bonding with the use of Si and $SiO_2$, after bonding Si to an anode and $SiO_2$ to a cathode, Si and $SiO_2$ are stacked one on top of the other, and a high voltage is applied to a bonding interface therebetween, whereupon $Na^+$ is precipitated on the surface of $SiO_2$, migrating to the cathode. At this point in time, negative holes are created in the bonding interface of $SiO_2$ and positively charged Si ions from an Si layer tend to migrate to fill up the holes. As a result, bonding of Si with $SiO_2$ can be implemented. Further, since Si has conductivity, it is possible to effect bonding with $SiO_2$ sandwiched between Si wafers. In this case, anodic bonding in two stages can be executed by changing over current.

With the embodiments described hereinbefore, silicon is used for a process material, however, glass and stainless maybe used instead taking alkali resistance into consideration. Since fine patterning of nozzles in the shape of a square with a side length about 30 μm, and so forth, is possible even on stainless, in which case, a further advantageous effect from the viewpoint of chemical resistance is anticipated.

Figure 10:
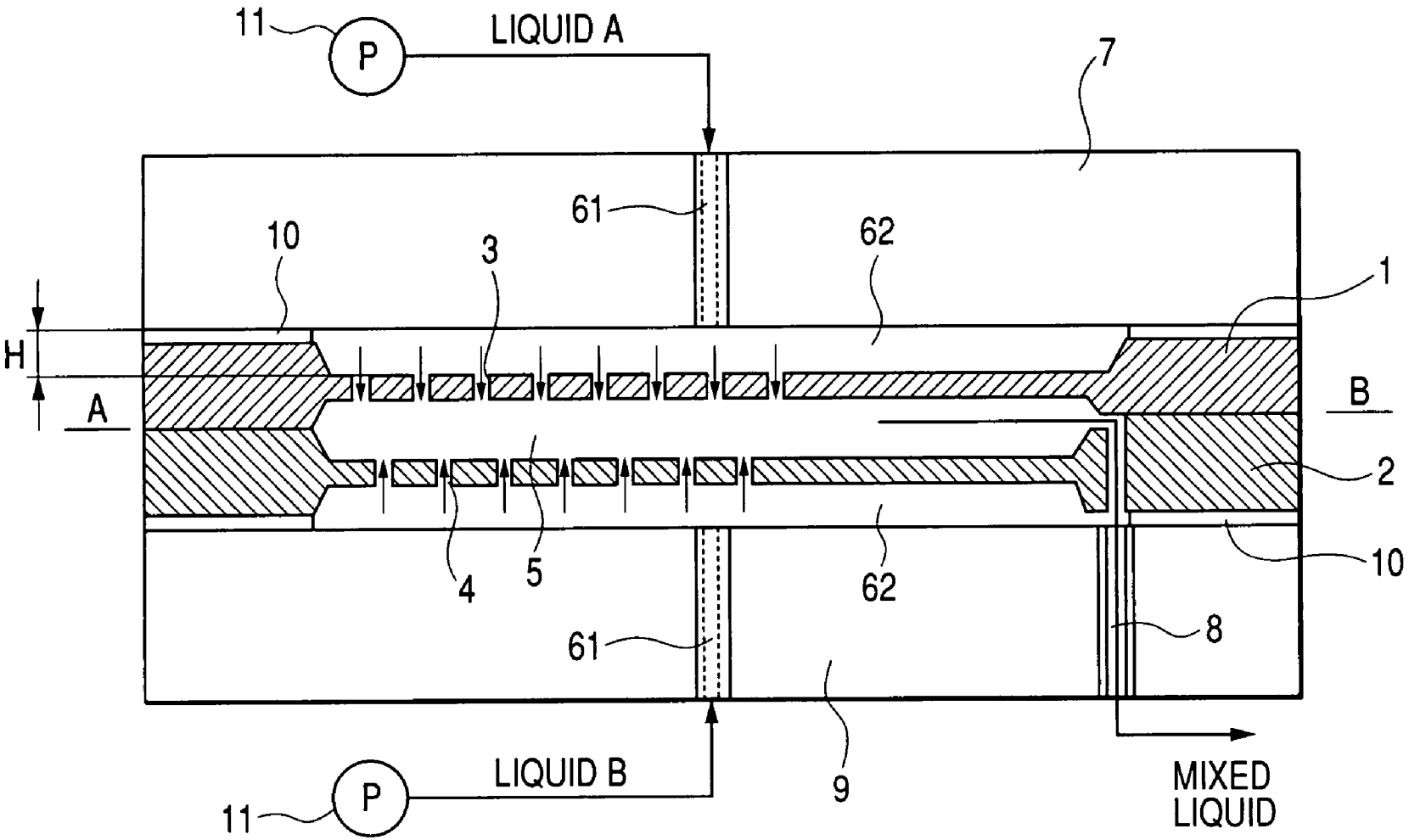
FIG. 10 is a schematic representation showing a third embodiment of the invention.

A third embodiment of the invention is described hereinafter with reference to FIG. 10. With the third embodiment, it is possible to implement a form capable of improving response characteristics and mixing performance. The third embodiment is provided with basically the same form as described with reference to the first embodiment. As shown in FIG. 10, the third embodiment is formed such that feed headers 62 each are at least smaller in volume than the mixing chamber 5. More specifically, the volume of each of the feed headers 62 is preferably rendered not more than one tenth of the volume of the mixing chamber 5 in order to form a mixer capable of coping with a minute flow rate (not more than several hundred μl/min). With this, it is possible to improve response characteristics as well as mixing performance. There is shown a form wherein the volume of each of the feed headers 62 is adjusted by use of an O-ring 10 installed between upper and lower base plates 1, 2 and mixer holder upper and lower plates 7, 9, respectively. Further, the mixing chamber 5 is formed such that the numbers of nozzles 3, 4 in a region closer to an outflow guide path 8 are less than those in a region farther away from the out flow guide path 8. Or, a region where no nozzle is formed is provided in a region closer to the outflow guide path 8. With this, a region where two liquids spurted through the nozzles, respectively, are shifted over time is provided, so that diffusion mixing of the two liquids is promoted, thereby enhancing mixing performance.

In the case of using the present embodiment as a gradient mixer for use in a liquid chromatography, it is possible to mix two liquids at a minute flow rate, thereby improving the response characteristics as well as the mixing performance.

Figure 11:
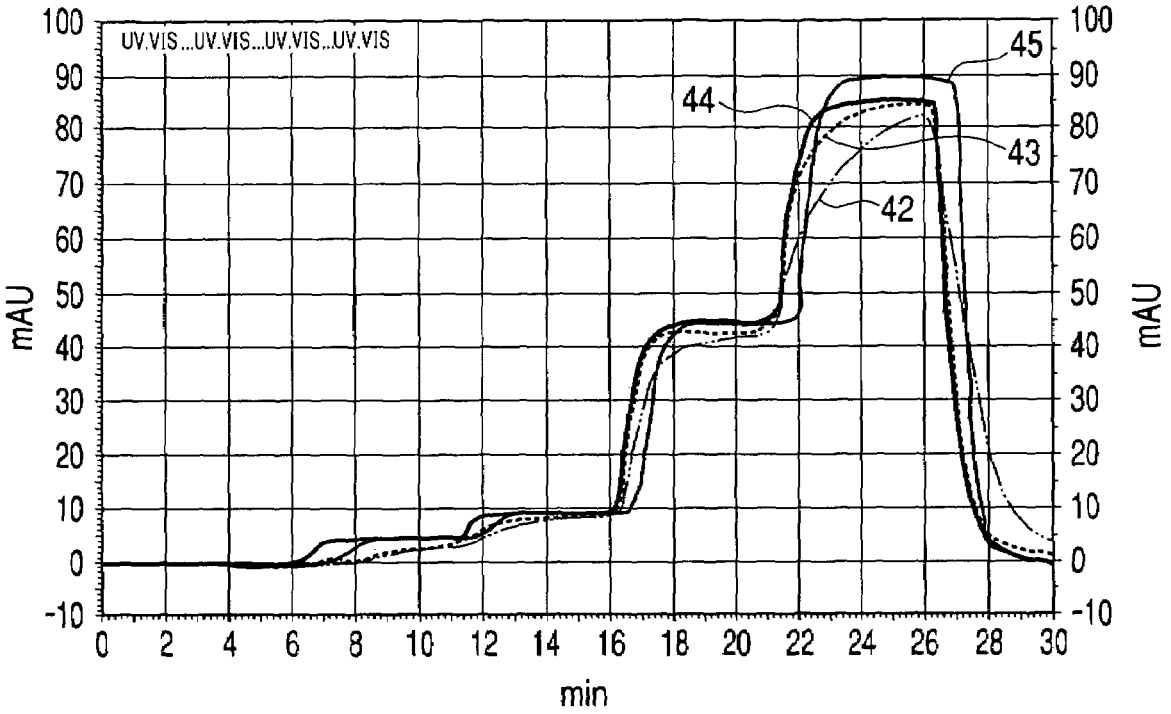
FIG. 11 is a graph showing results of a test conducted on a prototype mixer.

Further, with the present embodiment, dead volume can be decreased to thereby improve the response characteristics. In connection with the response characteristics, relationship between the volume of the mixing chamber and the volume of a feeder (flow path) for feeding a liquid to the mixing chamber was examined by varying the volume of the feeder (flow path) for feeding the liquid to the mixing chamber in stages. A method and condition of a test conducted are briefly described hereinafter. With the use of a liquid chromatography, a solvent liquid A (water) was fed to a mixer by a pump A while a solvent liquid B (acetone [0.1% $(CH_3)2CO$ in $H_2O$]) was fed to the mixer by a pump B, and the two liquids were mixed. The two liquids mixed in the mixer were discharged, and gradient evaluation was made in a UV detector 15 linked with the mixer. The mixing chamber was filled up 100% with the liquid A at first, and the liquid B was fed by the pump B in such a way as to vary the concentration of the liquid B to 0, 5, 10, 50, and 100% every 6 min, thereby detecting absorbance of the liquid B with the UV detector 15. With the total flow rate set to 200 μl/min, the mixer shown in FIG. 10 was mounted in the liquid chromatography to conduct the evaluation. In altering the volume of the feed header 62 for feeding the mixing chamber with the liquid, a depth H of a groove formed in the upper base plate 1, for forming the feed header 62 communicating with a feed path 61 shown in FIG. 10, from the mixer holder upper plate 7, was altered. In FIG. 11, there is shown the results of the test indicating gradient curves obtained at the test. In the figure, the vertical axis shows output values (mAu) of absorbance of the liquid B, detected by the UV detector, and the horizontal axis shows measurement time (min). The gradient curves in the figure represent a gradient curve 42 at a time when a holder groove was 6 mm in depth, a gradient curve 43 at a time when the holder groove was 3.8 mm in depth, a gradient curve 44 at a time when the holder groove was 1 mm in depth, and a gradient curve 45 at a time when a conventional holder was used, respectively. As shown in the figure, the deeper the depth of the holder groove becomes from 1 mm to 3.8 mm, and 6 mm, in steps, the more gently-sloped the gradient curve is obtained, and the more a delay occurs to rise time. In particular, when the concentration of the liquid B is increased rapidly from 50 to 100%, the deeper the holder groove, the shorter is a time band when the output value of the absorbance of the liquid B at 100% concentration is stabilized. To find a slope (mAu/min) of UV detection values against a feed groove volume (μl) at concentration in a range of 50 to 100%, assuming that a time when the detection value at, for example, 50% concentration starts rising is X1, an output value at that time is Y1, a time when the detection value at 100% concentration is reached is X2, and an output value at that time is Y2, the slope (mAu/min) of the UV detection values can be represented by a formula:

$$Y2-Y1/X2-X1$$

Figure 12:
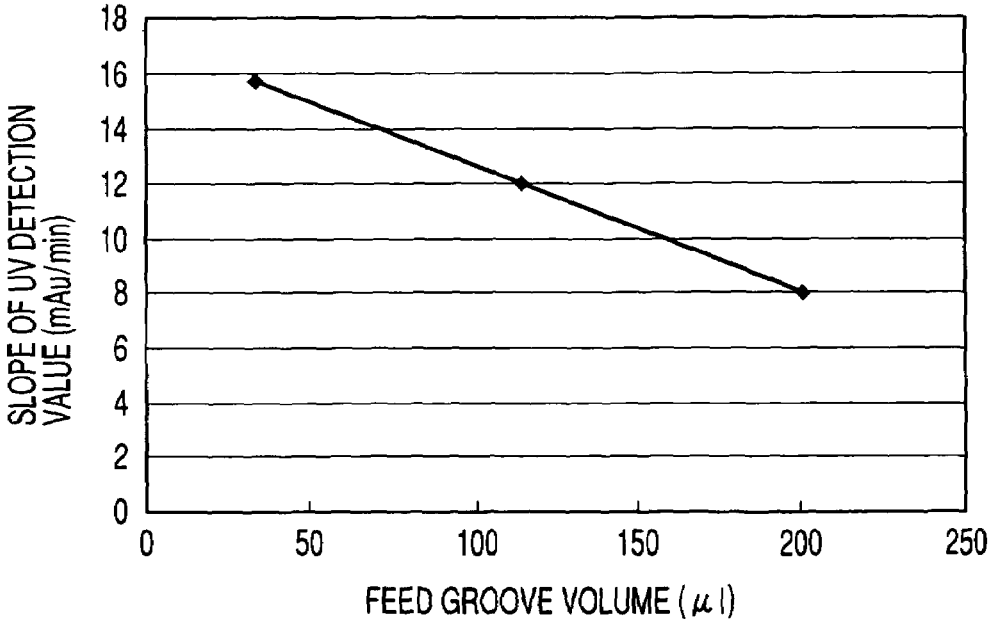
FIG. 12 is another graph showing results of the test conducted on the prototype mixer.

FIG. 12 shows relationship between the feed groove volume (μl) at concentration in the range of 50 to 100%, and the slope (mAu/min) of the UV detection values. It is evident from this that the response characteristics is enhanced by reducing dead volume in the volume of the mixing chamber 5 as swell as the volume of the feed header 62, which is a feeder (flow path) for feeding the mixing chamber 5 with the liquid. The volume of the feed header 62, that is, the feeder (flow path) is set to one tenth of the volume (for example, 200 μl) of the mixing chamber 5. Or the same is set so as to correspond to one tenth of a set flow rate (per minute). With this, even if the liquids spurted into the mixing chamber from the nozzles leaks out through the nozzles on one side, such leakage can be held down to the minimum. Further, the rise time can be shortened to not more than half of that in the case of the conventional mixer. In order to set a target rise time as short as possible so as to correspond to the result of the gradient curve, it is desirable to miniaturize the volume of the feed header 62 that is the feeder so as to equivalent to a range of 1/20 to 1/30 of the volume of the mixing chamber 5 if it is within a workable range.

Now, a fourth embodiment of the invention is described with reference to FIG. 13.

In this case, use can be made of the basically same form as described with reference to the first and third embodiments, respectively. With the fourth embodiment, feed headers 62 each are provided with a fist region 62*a* communicating with a feed path 61 for a liquid, and a second region 62*b* communicating with the fist region via a plurality of feeders for a first liquid, and communicating with nozzles 3 or 4.

More specifically, the feed header 62 has a porous material provided in the fist region 62*a* communicating with the feed path 61. In the figure, a filter is disposed.

More specifically, a region for a junction part between the fist region 62*a* and the second region 62*b* is formed so as to be wider than a region for a junction part between the feed path 61 and the fist region 62*a*. The interface part between the fist region 62*a* and the second region 62*b* is larger in width than the junction part between the feed path 61 and the fist region 62*a*.

With the adoption of such a constitution as described, mixing performance can be enhanced. By adopting a configuration such that liquids are diffused from feeders to the whole region of the nozzles disposed adjacent to each other in a mixing chamber when the liquids are fed into the mixing chamber, it is possible to reduce dead volume. As a result, advantageous effects of improvement in respect of response characteristics and mixing performance are anticipated.

In this case, a filter playing the role of rectifying liquid flow is effectively disposed in the mixing chamber. In the case where the filter is disposed, the filter may be quadrilateral or circular in section so as to cover the whole region of the nozzles disposed in the mixing chamber. Further, in setting the thickness of the filter, the thickness of the filter is preferably not more than a set flow rate (per 1 min)/an area of a whole nozzle region (a nozzle-disposed face inside the mixing chamber). Assuming that mixing set time is 3 (s), the depth of the mixing chamber is 50 μm, and in order that the liquids enter the mixing chamber in about 1 min, and undergo diffusion mixing in short time, the thickness of the filter is preferably in a range of 1 to not more than 2 mm (in order to cause time when a diffusion region shifts in the filter to fall within about 20 times the mixing set time, the thickness of the filter is preferably not more than about 20 times the depth of the mixing chamber).

Figure 14A:
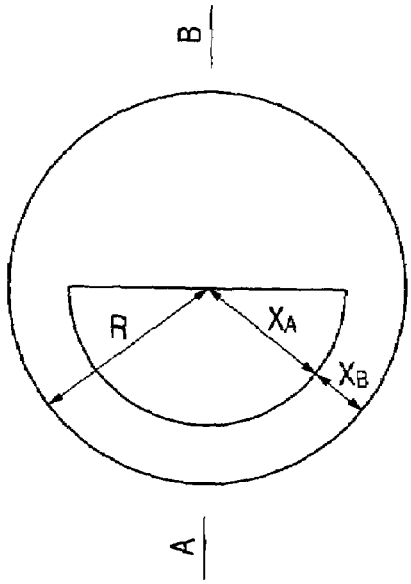
FIGS. 14A, 14B, and 14C are schematic representations showing a fifth embodiment of the invention.
Figure 14B:
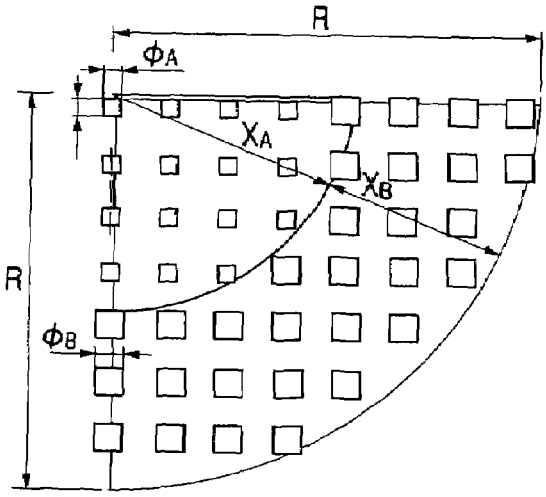
Figure 14C:
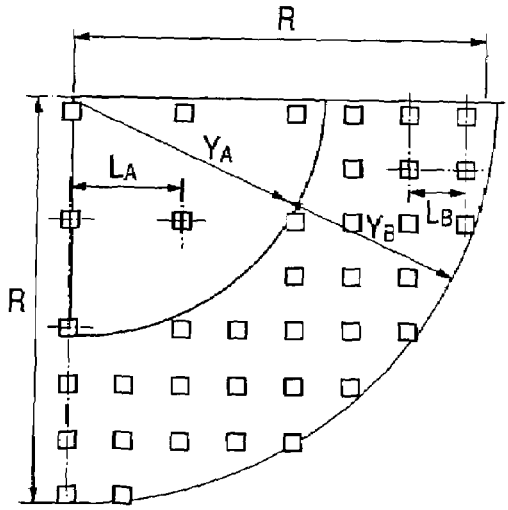

A fifth embodiment of the invention is described hereinafter with reference to FIGS. 14A to 14C. With the present embodiment, use can be made of the basically same form as described with reference to the first and other embodiments, respectively. Further, a feed path 61 is located at the center of a mixing chamber shown in plane figures of FIGS. 14A to 14C. The fifth embodiment is characterized in that upper face nozzles 3 or lower face nozzles 4, in a region closer to a junction part between the feed path 61 and a feed header 62, are varied in size of the spout thereof or pitch between the spouts from those in a region away from the junction part.

For example, the respective spouts of the nozzles 3 or the nozzles 4, in a first region closer to the feed path 61, are formed smaller in diameter than the respective spouts of the nozzles 3 or the nozzles 4, in a second region farther away from the feed path 61 than the first region.

Or a pitch between the respective spouts of the nozzles 3 or the nozzles 4, adjacent to each other, in the first region closer to the feed path 61, is set wider than that between the respective spouts of the nozzles 3 or the nozzles 4, adjacent to each other, in the second region farther away from the feed path 61 than the first region.

Figure 13:
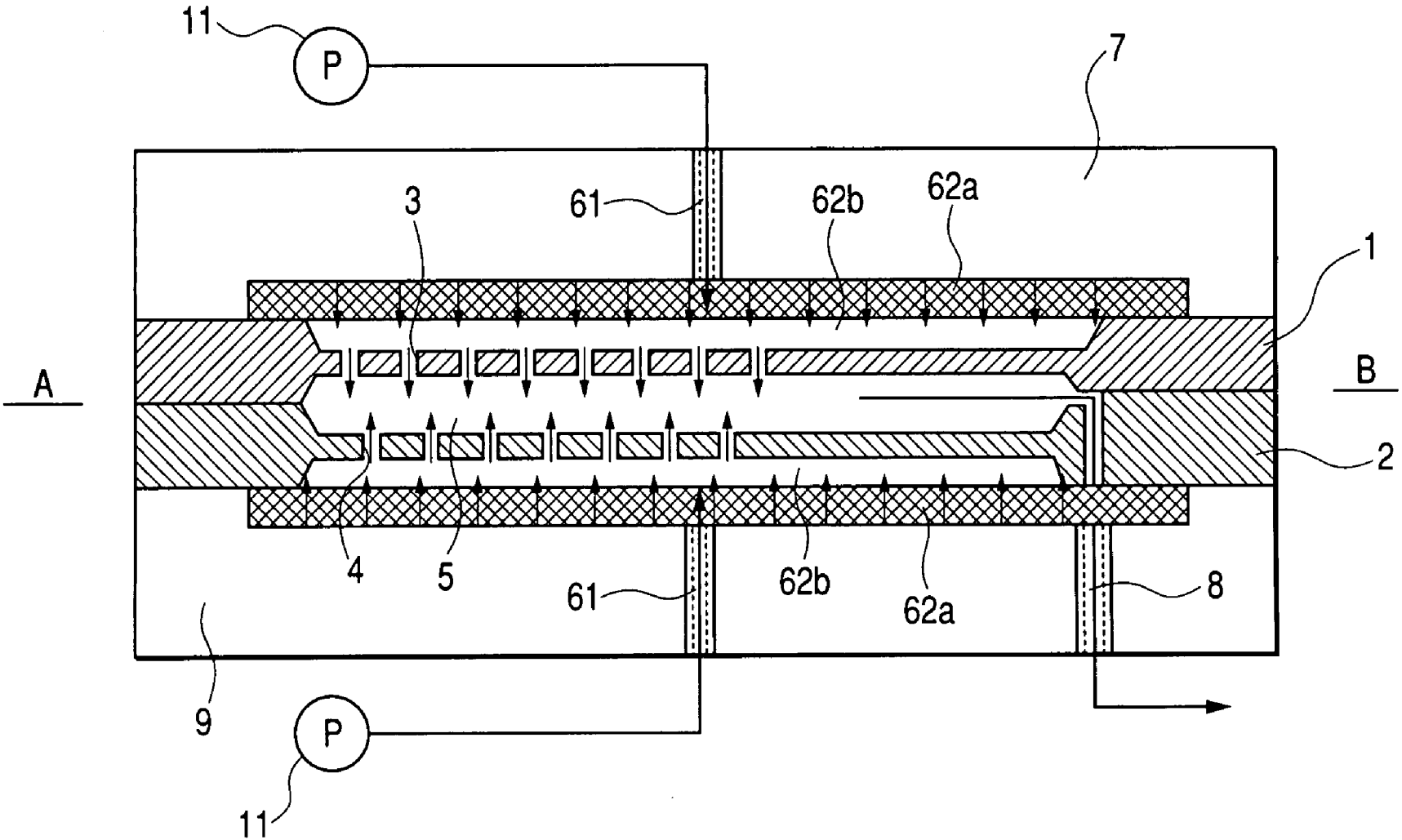
FIG. 13 is a schematic representation showing a fourth embodiment of the invention.

FIGS. 14 A to 14C broadly show regions where the nozzles are formed, in section taken in line A-B in FIG. 13 for the fourth embodiment. The nozzles are disposed symmetrically with respect to the feed path 61 located at the center, individually.

The respective sizes of the nozzles disposed in the central part of a mixing chamber are varied from those of the nozzles disposed in the inner peripheral part of the mixing chamber. That is, even if a sectional area of a feeder (flow path) inside the mixing chamber is smaller as compared with a nozzle-disposed face inside the mixing chamber, the nozzles in the first region and the nozzles in the second region are disposed such that the nozzles in the central part of the mixing chamber are differentiated in size from those in the inner peripheral part thereof, thereby reducing difference between time required for liquids to enter the respective nozzles in the central part of the mixing chamber, and time required for the liquids to enter those in the inner peripheral part thereof, at the time when the liquids enter the mixing chamber, so that it is possible to respond to a change in concentration even if a flow rate is altered. As a result, response characteristics and mixing performance can be improved. For example, in the case of a plurality of nozzles (spouts) being disposed in a region, in the shape of a circle, where the nozzles 3, or 4 are disposed symmetrically with respect to the feed path 61 at the center as shown in FIG. 14A, assuming that the radius of the circle is R, and Xa+Xb=R, where Xa; the radius of a circle of a region where the nozzles ϕA in diameter, through which a liquid A flows, are disposed, Xb; the radius of a circle of a region where the nozzles ϕB in diameter, through which a liquid B flows, are disposed, if ϕB>2ϕA when Xa>⅔ R, it is possible to reduce difference between the times required for the liquids to enter the nozzles in the central part of the mixing chamber, and in the inner peripheral part thereof, respectively, since the nozzles in the outer part are larger in diameter than the nozzles in the central part of the mixing chamber. FIG. 14B shows the state of shapes of the respective nozzles in this case.

Similarly, by disposing the nozzles in the first region and the nozzles in the second region such that the nozzles in the central part of the mixing chamber are differentiated in nozzle pitch (interval between the adjacent nozzles) or nozzle density from those in the inner peripheral part thereof, it is possible to reduce difference between the times required for the liquids to enter the nozzles in the central part of the mixing chamber, and in the inner peripheral part thereof, respectively, so that an advantageous effect of responding to a change in concentration can be anticipated. For example, in the case of a plurality of nozzles being disposed in a mixer, in the shape of a circle, as shown in FIG. 14C, assuming that the radius of a circle is R, and Ya+Yb=R, where Ya; the radius of a circle of a region where the nozzles, through which the liquid A flows, are disposed at pitches La, Yb; the radius of a circle of a region where the nozzles, through which the liquid B flows, are disposed at pitches Lb, if Lb<½ La when Ya>⅔ R, it is possible to reduce difference between times required for the liquids to enter the central part of the mixing chamber, and the outer part thereof, respectively, since the nozzle pitches in the outer part of the mixing chamber are larger as compared with those in the central part thereof.

A sixth embodiment of the invention is described hereinafter with reference to FIGS. 15A and 15B. With the present embodiment, use can be made of the basically same form as described with reference to the first and other embodiments, respectively. With the present embodiment, besides a liquid fed through upper face nozzles 3 provided in an upper base plate 1, and a liquid fed through lower face nozzles 4 provided in a lower base plate 2, a third liquid is fed to a mixing chamber through third nozzles provided in a side face of the mixing chamber. The third nozzles are a multitude of nozzles formed by disposing the upper base plate 1 so as to oppose a multitude of grooves formed in the lower base plate 2, and the third liquid is fed from a liquid feeder formed in a space between the upper base plate 1 and the lower base plate 2 to the mixing chamber 5 through the multitude of nozzles.

Figure 15A:
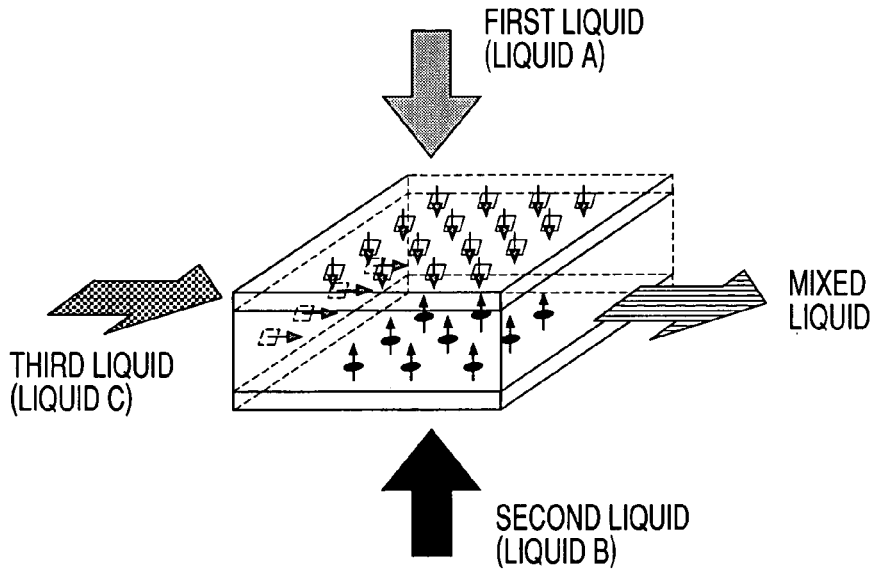
FIGS. 15A and 15B are schematic representations showing a sixth embodiment of the invention.
Figure 15B:
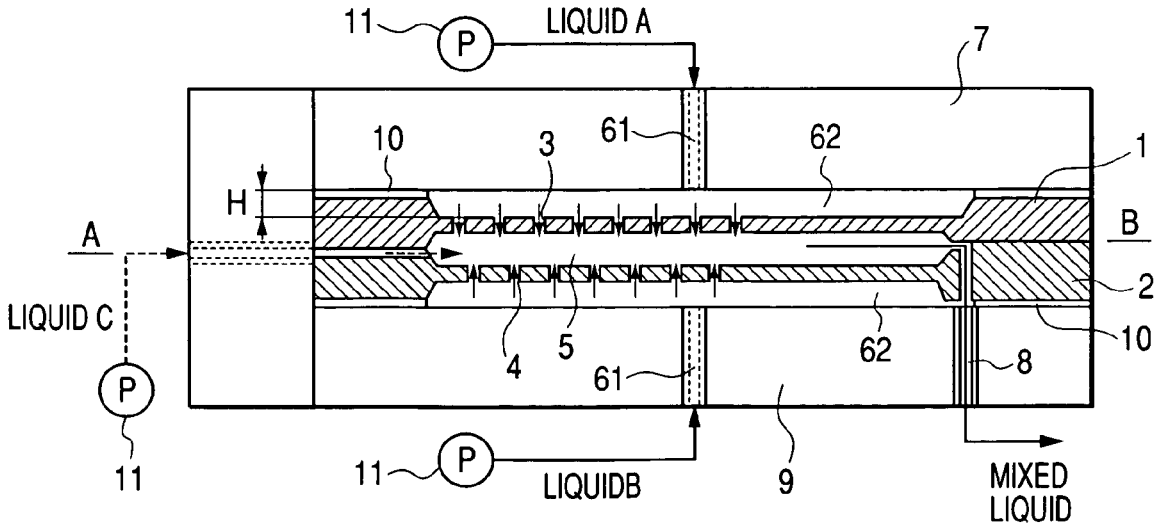

FIG. 15A is a conceptual view showing such operation. By mixing three kinds of solvent liquids, it is possible to variously change the kind, concentration, and composition of a mixed liquid, thereby enabling a multitude of kinds of compounds to be separated as compared with the case of mixing two kinds of solvent liquids. The third nozzles for feeding the third liquid are preferably disposed at the same pitches as pitches at which the nozzles 3, 4 are disposed in the upper and lower wall faces of the mixing chamber, respectively. However, if the mixing chamber is low in profile, and there is difficulty with disposing a plurality of the third nozzles in the side face of the mixing chamber, it is desirable to narrow down the pitches. The same applies to the diameters of the respective nozzles.

With the use of the mixer according to the present embodiment for the micro-liquid chromatography shown in FIG. 1, use can be made of a multitude of kinds of solvent liquids for separation of a multitude of kinds of compounds, so that it is expected that separation items are increased and compounds in trace amounts are separated to be analyzed.

What is claimed is:

1. A mixer comprising:

a first feeder for a first liquid;

a second feeder for the first liquid;

a feeder for a second liquid, formed between the first feeder for the first liquid and the second feeder for the first liquid;

a first mixing unit formed between the first feeder for the first liquid and the feeder for the second liquid; and a second mixing unit formed between the second feeder for the first liquid and the feeder for the second liquid wherein the first mixing unit or second mixing unit includes:

a first base plate having a plurality of spouts for spurting the first liquid, formed therein;

a second base plate having a plurality of spouts for spurting the second liquid, formed therein; and a mixing chamber formed between the first base plate and the second base plate, for mixing the first liquid with the second liquid.

2. The mixer according to claim 1, wherein the mixing chamber has a discharge path for a mixed liquid as mixed, formed between the first base plate and the second base plate.

3. The mixer according to claim 1, wherein a position reached by extending a spurting direction of a first spout for the first liquid toward the second base plate falls between a first spout for the second liquid and a second spout for the second liquid.

4. The mixer according to claim 1, wherein the first or second feeder for the first liquid has a first feed path for feeding the first liquid, and a first feed header communicating with the first feed path and the plurality of spouts for the first liquid, wherein the first feed header is formed smaller in volume than the mixing chamber.

5. The mixer according to claim 1, wherein the first or second feeder for the first liquid has a first feed path for feeding the first liquid, wherein the first feed header has a first region communicating with the first feed path, and a second region communicating with the first region via a plurality of feeders of the first liquid, and communicating with the spouts for the first liquid.

6. The mixer according to claim 5, wherein a region for a junction part between the first region and the second region is formed so as to be wider than a region for a junction part between the first feed path and the first region.

7. A mixer comprising:

a feeder for a first liquid;

a feeder for a second liquid;

first nozzles formed in a first base plate, communicating with the feeder for the first liquid, having a plurality of spouts for the first liquid;

second nozzles formed in a second base plate, communicating with the feeder for the second liquid, having a plurality of spouts for the second liquid; and a mixing unit for mixing the first liquid spurted from the first nozzles with the second liquid spurted from the second nozzles;

wherein the feeder for the first liquid has a first feed path for feeding the first liquid, and a first feed header communicating with the first feed path and the plurality of spouts for the first liquid, and the spouts for the first liquid, in a first region closer to the first feed path, are formed smaller in diameter than the spouts for the first liquid, in a second region farther away from the first feed path than the first region.

8. The mixer according to claim 7, wherein the mixing unit has a discharge path for a mixed liquid as mixed, formed between the first base plate and the second base plate.

9. The mixer according to claim 7, wherein a position reached by extending a spurting direction of a first spout for the first liquid toward the second base plate falls between a first spout for the second liquid and a second spout for the second liquid.

10. The mixer according to claim 7, wherein the first feed header is formed smaller in volume than the mixing unit.

11. The mixer according to claim 7, wherein the first feed header has a first region communicating with the first feed path, and a second region communicating with the first region via a plurality of feeders of the first liquid, and communicating with the spouts for the first liquid.

12. The mixer according to claim 11, wherein a region for a junction part between the first region and the second region is formed so as to be wider than a region for a junction part between the first feed path and the first region.

13. A mixer comprising:

a feeder for a first liquid;

a feeder for a second liquid;

first nozzles formed in a first base plate, communicating with the feeder for the first liquid, having a plurality of spouts for the first liquid;

second nozzles formed in a second base plate, communicating with the feeder for the second liquid, having a plurality of spouts for the second liquid; and a mixing unit for mixing the first liquid spurted from the first nozzles with the second liquid spurted from the second nozzles;

wherein the feeder for the first liquid has a first feed path for feeding the first liquid, and a first feed header communicating with the first feed path and the plurality of spouts for the first liquid, and a pitch between the spouts for the first liquid, in a first region closer to the first feed path, are set wider than that between the spouts for the first liquid, in a second region farther away from the first feed path than the first region.

14. The mixer according to claim 13, wherein the mixing unit has a discharge path for a mixed liquid as mixed, formed between the first base plate and the second base plate.

15. The mixer according to claim 13, wherein a position reached by extending a spurting direction of a first spout for the first liquid toward the second base plate falls between a first spout for the second liquid and a second spout for the second liquid.

16. The mixer according to claim 13, wherein the first feed header is formed smaller in volume than the mixing unit.

17. The mixer according to claim 13, wherein the first feed header has a first region communicating with the first feed path, and a second region communicating with the first region via a plurality of feeders of the first liquid, and communicating with the spouts for the first liquid.

18. The mixer according to claim 17, wherein a region for a junction part between the first region and the second region is formed so as to be wider than a region for a junction part between the first feed path and the first region.

* * * * *